US006644741B2

(12) United States Patent
Nelson et al.

(10) Patent No.: US 6,644,741 B2
(45) Date of Patent: Nov. 11, 2003

(54) CHAIR

(75) Inventors: Patrick C. Nelson, Holland, MI (US); Manfred Kleinikel, Ahlen (DE); Werner Härtel, Drensteinfurt (DE)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/957,695

(22) Filed: Sep. 20, 2001

(65) Prior Publication Data

US 2003/0052521 A1 Mar. 20, 2003

(51) Int. Cl.[7] ..... A47C 7/60

(52) U.S. Cl. ..... 297/302.1; 297/316; 297/300.1; 297/300.2; 297/321

(58) Field of Search ..... 297/316, 300.5, 297/300.1, 300.2, 320, 321, 318, 302.1, 300.3, 300.7, 303.3, 300.4, 303.5, 303.1

(56) References Cited

U.S. PATENT DOCUMENTS

| | | | | | |
|---|---|---|---|---|---|
| 2,447,601 | A | | 8/1948 | Sengpiel | |
| 2,859,801 | A | | 11/1958 | Moore | |
| 3,072,436 | A | | 1/1963 | Moore | |
| 4,375,301 | A | | 3/1983 | Pergler et al. | |
| 4,429,917 | A | | 2/1984 | Diffrient | |
| 4,502,729 | A | | 3/1985 | Locher | |
| 4,666,121 | A | * | 5/1987 | Choong et al. | 248/575 |
| 4,684,173 | A | * | 8/1987 | Locher | 297/300.3 |
| 4,709,962 | A | | 12/1987 | Steinmann | |
| 4,776,633 | A | | 10/1988 | Knoblock et al. | |
| 4,779,925 | A | | 10/1988 | Heinzel | |
| 4,966,411 | A | | 10/1990 | Katagiri et al. | |
| 4,979,778 | A | | 12/1990 | Shields | |
| 4,988,145 | A | | 1/1991 | Engel | |
| 5,005,905 | A | | 4/1991 | Sondergedl | |
| 5,042,876 | A | * | 8/1991 | Faiks | 297/301.4 |
| 5,071,189 | A | | 12/1991 | Kratz | |
| 5,318,345 | A | * | 6/1994 | Olson | 297/300.5 |
| 5,333,368 | A | | 8/1994 | Kriener et al. | |
| 5,348,372 | A | * | 9/1994 | Takamatsu et al. | 297/303.1 |
| 5,354,120 | A | | 10/1994 | Völkle | |
| 5,366,274 | A | | 11/1994 | Roericht et al. | |
| 5,582,459 | A | * | 12/1996 | Hama et al. | 297/300.2 |
| 5,725,277 | A | * | 3/1998 | Knoblock | 297/300.4 |
| 5,772,282 | A | | 6/1998 | Stumpf et al. | |
| 5,775,774 | A | | 7/1998 | Okano | |
| 5,806,930 | A | * | 9/1998 | Knoblock | 297/300.1 |
| 5,810,439 | A | * | 9/1998 | Roslund, Jr. | 297/300.4 |
| 6,382,723 | B1 | * | 5/2002 | Piretti | 297/300.1 |
| 6,425,633 | B1 | * | 7/2002 | Wilkerson et al. | 297/300.2 |
| 6,431,649 | B1 | * | 8/2002 | Hensel | 297/300.2 |
| 6,439,661 | B1 | * | 8/2002 | Brauning | 297/300.2 |

FOREIGN PATENT DOCUMENTS

| | | |
|---|---|---|
| EP | 0 250 207 | 12/1987 |
| EP | 0 784 952 | 7/1997 |

* cited by examiner

*Primary Examiner*—Peter M. Cuomo
*Assistant Examiner*—Stephanie Harris
(74) *Attorney, Agent, or Firm*—Flynn, Thiel, Boutell & Tanis, P.C.

(57) ABSTRACT

A synchrotilt mechanism for a chair to provide improved control over the relative but synchronized tilting of the back and seat during tilting. The chair back is supported on a rigid upright assembly including lower lever arms which project under the chair seat and are coupled at forward ends to a horizontal tilt shaft which is disposed under the front of the chair seat and is supported on a control housing fixed to the upper end of the base pedestal. A tension control mechanism is coupled between the tilt shaft and the control housing for normally urging the upright arrangement, and the chair back, into an upright position. The chair seat is movably supported on the lower lever arms by a support arrangement which permits the chair seat to pivot relative to the upright assembly about a generally transverse horizontal axis which is preferably slightly below the upper surface of the seat when the latter is in a nondeformed condition, i.e., the seat is not occupied. A control mechanism is coupled between the control housing, the upright assembly and the seat frame to permit synchronized tilting of the seat relative to the back in response to tilting of the back about the axis of the tilt shaft.

21 Claims, 9 Drawing Sheets

CHAIR

FIELD OF THE INVENTION

This invention relates to an office-type chair, and more specifically relates to an improved synchrotilt mechanism coupled to the seat and back of the chair for providing improved seating comfort.

BACKGROUND OF THE INVENTION

Office chairs conventionally provide some type of rearward tilting movement. In its simplest variations, the rear tilting involves solely the back, or the seat and back as a unitary construction. To provide improved and more desirable tilting movement and seating comfort, however, many office-type chairs employ a synchrotilt mechanism coupled between the chair base and the seat-back assembly, for permitting the seat and back to simultaneously tilt at different rates, with the tilt rate and maximum tilt angle of the back typically being about twice the tilt rate and maximum tilt angle of the seat.

Chairs employing synchrotilt mechanisms for permitting simultaneous but relative tilting of the seat and back are well known, and numerous mechanisms have been developed for performing this function. Most of these mechanisms, however, have caused relative motion between the chair and the seated occupant which has interfered with occupant comfort. Such relative motion may involve relative sliding between the seat and the occupant's hips or thighs, and/or sliding between the chair back and the occupant's back, during the relative tilting between the seat and back. In an attempt to alleviate or at least partially compensate for this problem, several chair mechanisms have been developed which cause the seat, during rearward tilting of the seat-back arrangement, to tilt relative to the back about an axis located approximately at the hip axis of the seated occupant. This hip axis is disposed in upwardly spaced relation from the rear portion of the seat, and spaced forwardly from the lower portion of the chair back. While locating the relative tilt axis between the seat and back at the occupant's hip axis is believed to provide improved performance, particularly with respect to minimizing the relative sliding motion between the seated occupant and the seat/back, nevertheless many of these known mechanisms still fail to provide the degree of performance desired, particularly with respect to the desired comfort and ease of movement (often referred to as "ride") associated with tilting of the chair.

Accordingly, it is an object of this invention to provide an improved synchrotilt mechanism for a chair which is believed to provide improved control over the relative but synchronized tilting of the back and seat during tilting of the seat-back assembly so as to provide improved occupant comfort and ride while providing improved performance with respect to minimization of the relative sliding movement between the seated occupant and the back and/or seat of the chair.

More specifically, in the improved chair of the present invention, the chair back is supported on a rigid upright assembly which includes lower lever arms which project under the chair seat and are coupled at forward ends thereof to a horizontal tilt shaft which is disposed under the front of the chair seat and is supported on a control housing fixed to the upper end of the base pedestal. A conventional tension control mechanism is disposed in the control housing and coupled between the tilt shaft and the control housing for normally urging the upright arrangement, and the chair back, into an upright position. The chair seat is movably supported on the lower lever arms of the upright assembly by a support arrangement which permits the chair seat to pivot relative to the upright assembly about a generally transverse horizontal axis which is preferably slightly below the upper surface of the seat when the latter is in a nondeformed condition, i.e., the seat is not occupied. A tilt control mechanism is coupled between the control housing, the upright assembly and the seat frame so as to permit synchronized tilting of the seat relative to the back in response to tilting of the back about the axis of the tilt shaft.

With the improved arrangement of the present invention, as briefly summarized above, rearward tilting of the chair back, and relative but synchronized tilting of the chair seat, as controlled by the tilt control linkage which is coupled between the chair back and seat and the stationary control housing, as well as the tilt support mechanism which couples the seat to the upright assembly, enables the body of the chair occupant to more naturally flex at various joints so as to provide for improved user comfort when the chair is occupied. More specifically, during the rearward and synchronized tilting of the seat and back, both the seat and back remain in proper supportive engagement with the occupant's body so as to effectively eliminate or at least greatly minimize any relative sliding between the occupant's body and either the back or seat. At the same time, the occupant's body undergoes natural flexing and opening of the angle at the ankle joint, the knee joint and the hip joint as the chair is tilted rearwardly, while enabling the occupant's feet to remain comfortably and stably supported on the floor throughout the range of rearward tilt movement, thereby providing an improved degree of comfort to the seated occupant which is believed at least equivalent to mechanisms which provide so-called "knee tilt" or "ankle tilt" motion.

In the improved chair of the present invention, the tiltable support of the seat on the upright assembly, so as to permit relative tilting therebetween in response to tilting of the back, is configured so that tilting of the seat relative to the upright occurs about an axis which is disposed below the normal nondeformed upper surface of the seat, whereby this axis hence is disposed approximately at the contact zone between the hip bone and the seat when the seat is occupied and deformed, thereby permitting a more natural rolling contact between the hip bone and the seat so as to eliminate or at least greatly minimize any relative sliding at the contact zone.

Other objects and purposes of the present invention will be apparent to persons familiar with chair constructions upon reading the following specification and inspecting the accompanying drawings.

Figure 1:
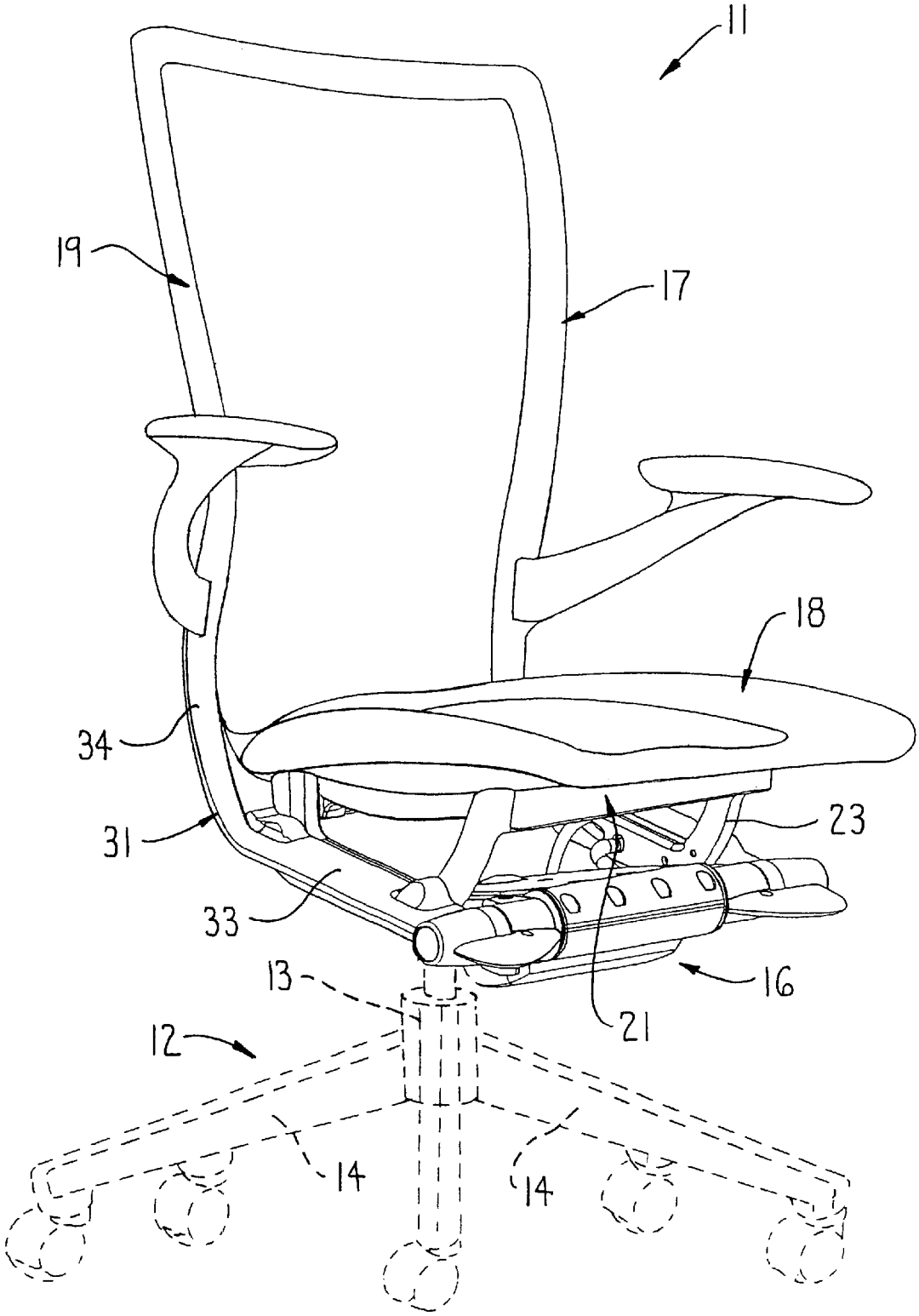
FIG. 1 is a perspective view of an office-type chair employing the improved tilt control mechanism of the present invention.
Figure 2:
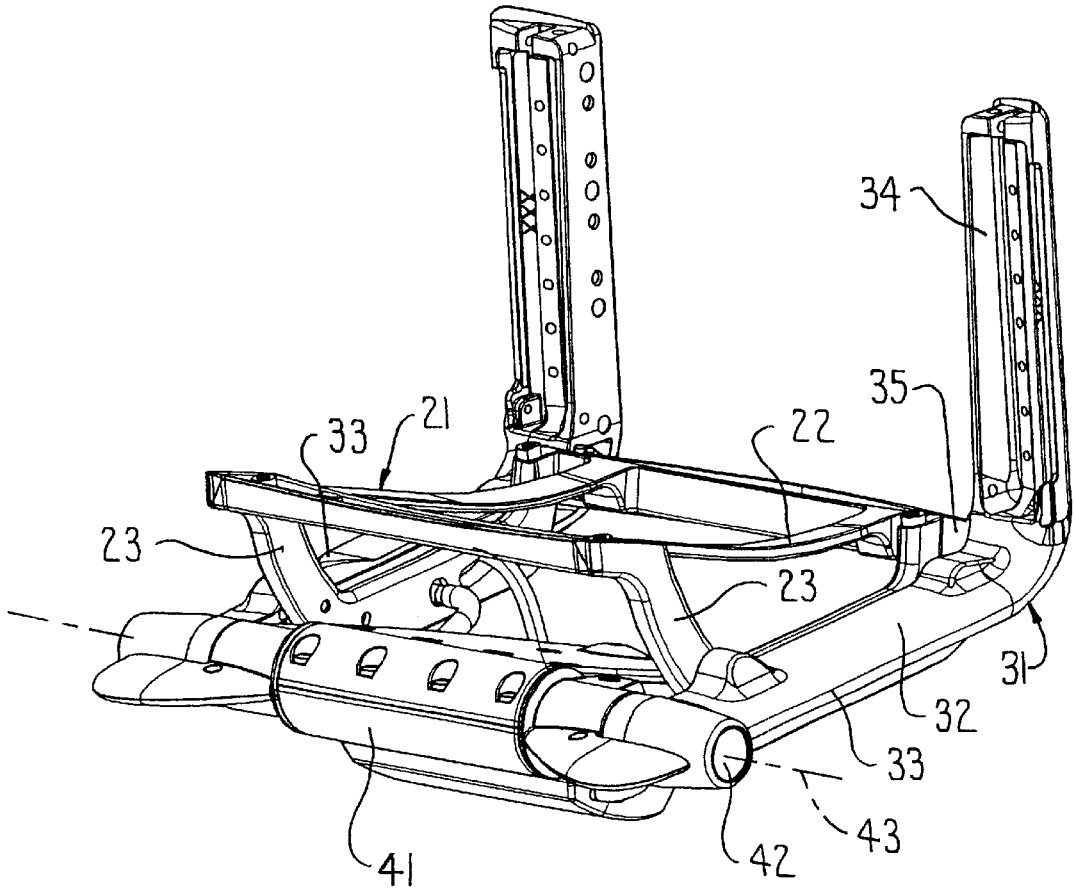
FIG. 2 is a perspective view showing the upright assembly having the seat cradle mounted thereon, and showing the connection to the chair control housing according to the present invention.
Figure 3:
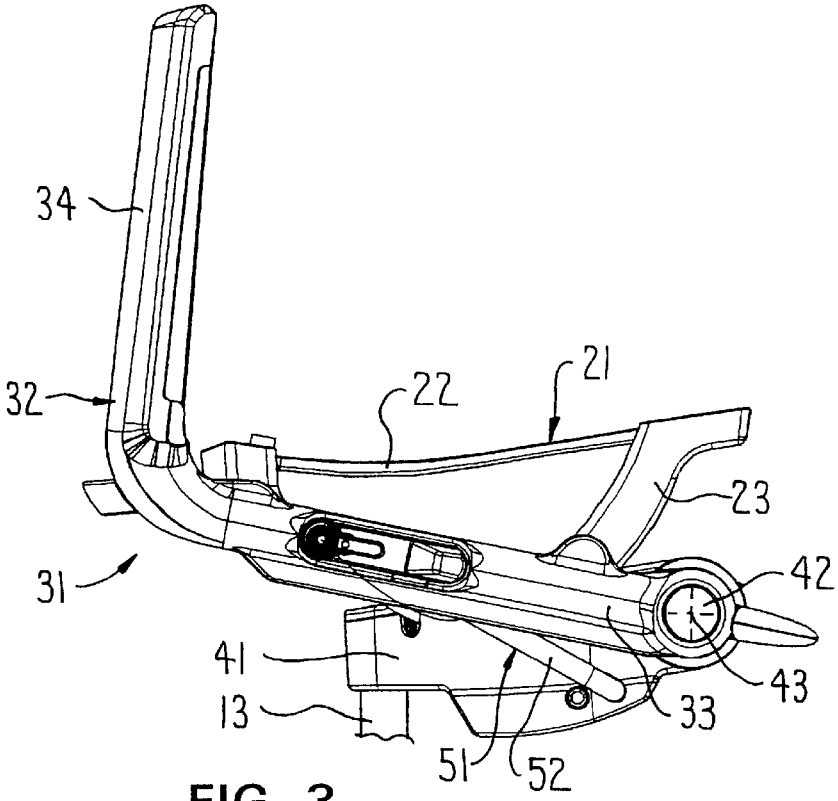
FIG. 3 is a side elevational view of the assembly shown in FIG. 2.
Figure 4:
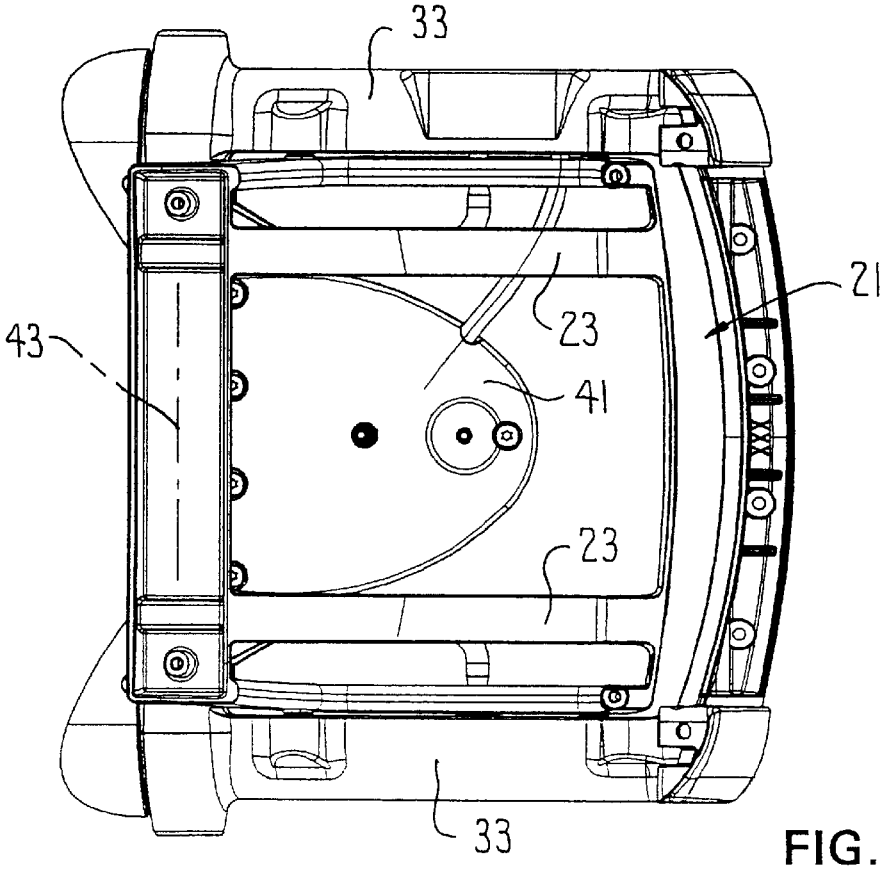
FIG. 4 is a top view of the assembly shown in FIG. 3.
Figure 5:
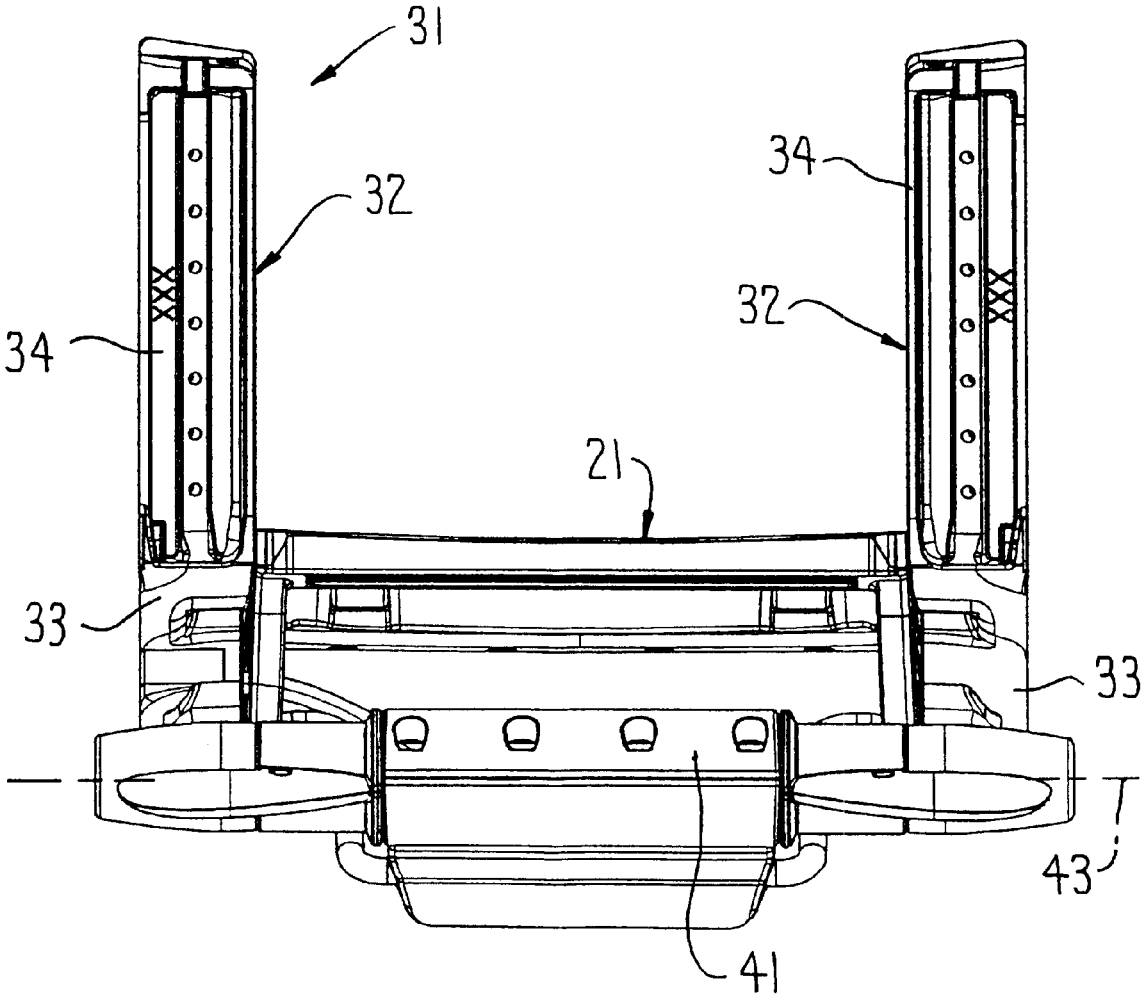
FIG. 5 is a front view of the assembly shown in FIG. 3.

Certain terminology will be used in the following description for convenience in reference only, and will not be limiting. For example, the words "upwardly", "downwardly", "rightwardly" and "leftwardly" will refer to directions in the drawings to which reference is made. These latter terms will also refer to the normal directions and positional orientations associated with a person sitting in the chair. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Referring to FIG. 1, there is illustrated a chair 11 according to the present invention. The chair 11 includes a base 12 provided with a plurality of legs 14 which radiate outwardly and are provided with casters for rolling support on a floor. The base 12, centrally thereof, has a height-adjustable pedestal 13 which projects upwardly and, at the upper end thereof, couples to a chair control 16, the latter in turn providing support for an L-shaped seat-back arrangement 17 which includes a seat assembly 18 and a back assembly 19.

The seat assembly 18 includes a rigid seat frame or cradle 21 defined by a generally rectangular ring-shaped top frame 22 which, adjacent opposite sides, is provided with generally parallel side frame elements 23. The elements 23 are generally U-shaped and protrude downwardly, with upper ends of the legs being rigidly joined adjacent the front and rear corners of the top frame 22.

The seat assembly 18 also includes a thin sheetlike seat shell 24 stationarily positioned on the upper surface of the top frame 22, and a compressible seat cushion 25 supported on and extending generally coextensively over the upper surface of the seat shell 24. The cushion 25 terminates in respective front and rear edges 26 and 27, the latter being defined in close proximity to the back assembly 19. The seat cushion defines thereon an upper surface 28 disposed for contacting engagement with a chair occupant. The seat cushion 25, when engaged with a seated occupant, resiliently deforms downwardly so that the upper surface 28, at least in the main central region of the cushion where engaged with the occupant, is deflected downwardly from the nondeformed position indicated in FIGS. 6 and 7.

The back assembly 19 is supported on a generally rigid upright structure 31 which is defined by a pair of generally parallel and sidewardly positioned L-shaped side upright elements or members 32, each of which has a lower lever arm portion 33 positioned below the seat shell 24 and which, at a rearward end, is joined through an integral bend to an upper arm portion 34 which is cantilevered upwardly and has the back assembly 19 mounted thereon. The sidewardly spaced uprights 32 are, adjacent the lower ends of the upper arm portions 34, rigidly joined by a cross member 35 extending therebetween.

The forward ends of the lower lever arm portions 33 are nonrotatably connected to a tilt shaft 42 which defines a rotational axis 43 extending generally horizontally in transverse relationship relative to the seat assembly 18. The tilt shaft 42 is rotatably supported within a housing or support arm 41 which is fixed to the upper end of the height-adjusting pedestal 13, with the housing 41 being cantilevered forwardly from the pedestal so that the tilt shaft 42 is positioned under but more closely adjacent the front edge 26 of the seat cushion 25.

The tilt shaft 42 projects outwardly through openings 44 formed in opposite sides of the housing 41 so that opposite end portions of the tilt shaft 42 are disposed on opposite sides of the housing 41. The projecting end portions of the shaft 42 in turn project through openings 45 associated with the forward ends of the lower lever arm portions 33, with these latter arm portions being keyed or otherwise suitably nonrotatably secured to the shaft 42, whereby the rigid upright arrangement 31 is angularly movable about the horizontal axis 43 in correspondence with angular displacement of the tilt shaft 42.

Figure 8:
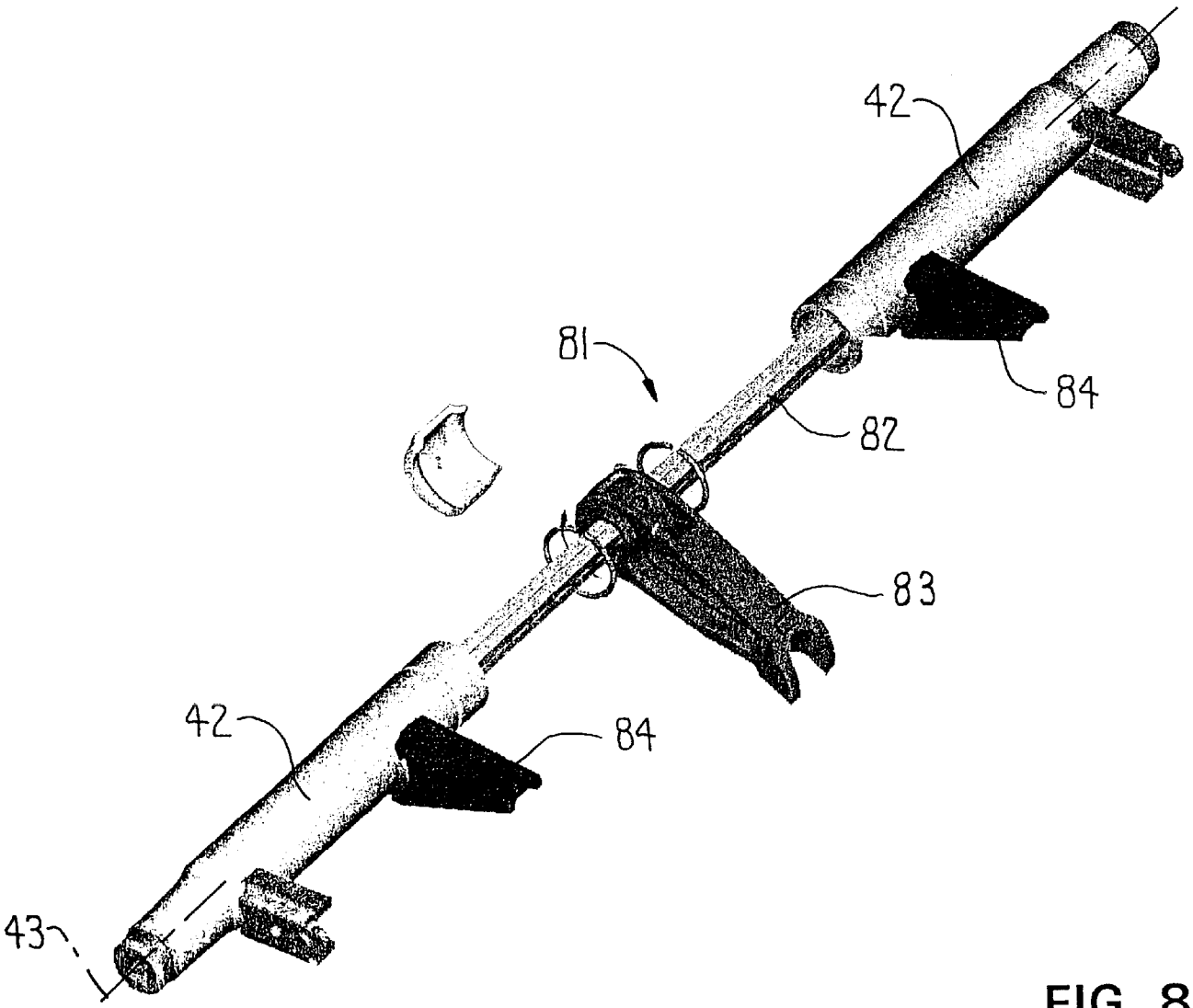
FIG. 8 is a perspective view, in a partially disassembled condition, of the main tilt shaft for the chair and its connection to a biasing unit.
Figure 9:
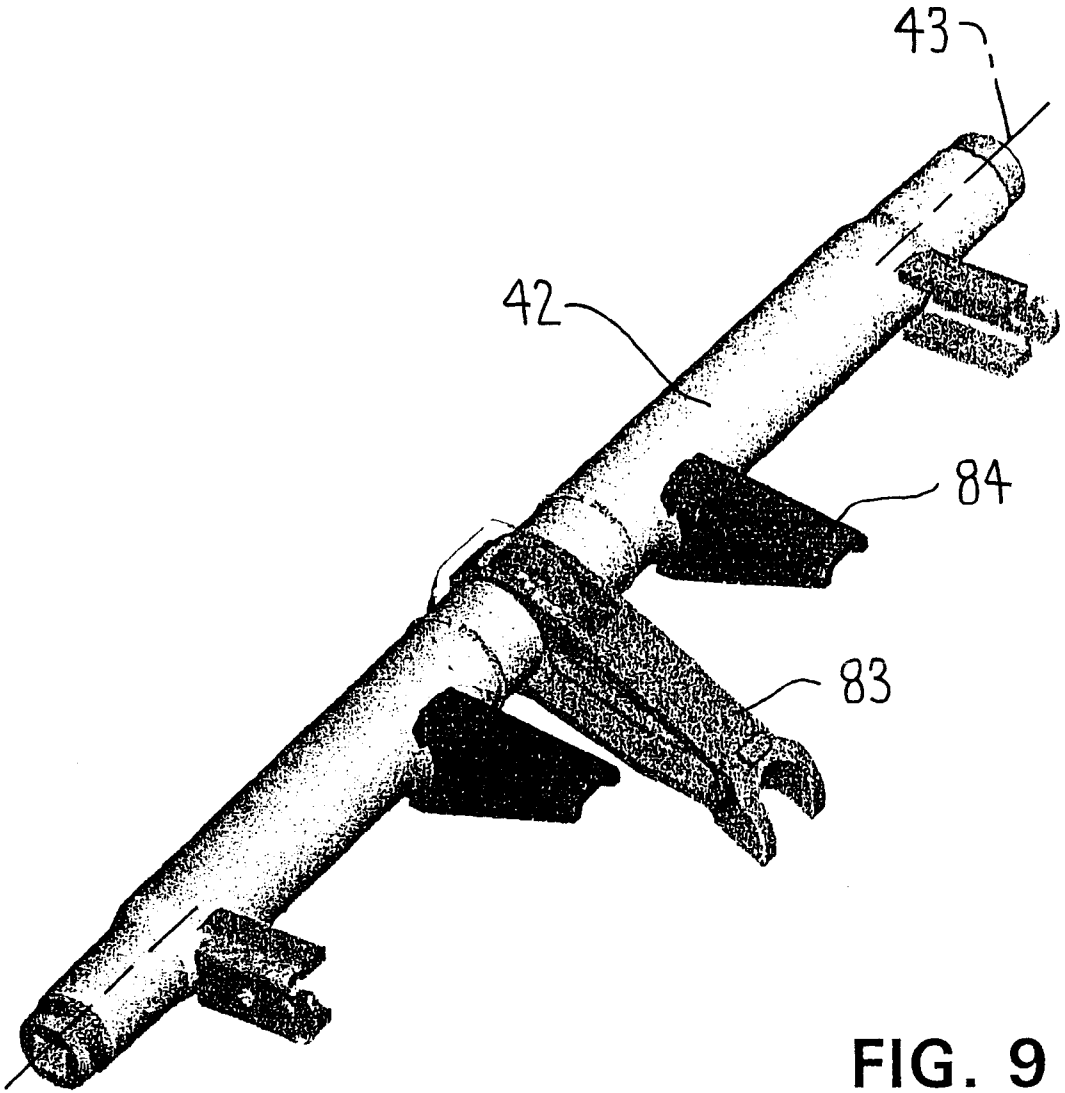
FIG. 9 is a perspective view of the assembled tilt shaft arrangement of FIG. 8.

The housing 41 functions as an enclosure for a conventional biasing or spring mechanism for normally urging the back assembly 19 into an upright position. In the present invention, and as illustrated in FIGS. 8–9, the chair employs a biasing or spring mechanism 81 which is disposed within the interior of the control housing 41 and includes a spring 82, namely an elongate bar-like torsion spring in the illustrated embodiment. This torsion spring 82 has an arm 83 anchored thereto substantially at the center of the spring, which arm at its other end is stationarily interconnected to the control housing 41, typically through a manually-adjustable tensioning mechanism which permits limited swinging of the arm so as to adjust the initial torsion of the torsion spring 82. This torsion spring 82, as it projects outwardly from opposite sides of the mounting arm 83, is telescoped within the interior of coaxially aligned shaft segments which define the main tilt shaft 42, and the free ends of the torsion spring 82 are nonrotatably secured to the shaft segments defining the shaft 42. The shaft segments also have stop members 84 fixed thereto and cooperating with opposed stops (not shown) associated with the control housing 41 for defining the permissible angle of movement of the shaft 42 and of the back arrangement as coupled thereto through the upright structure. While the biasing mechanism 81 as described above represents one arrangement for effecting biasing of the chair into its normal upright position, it will be recognized that numerous other biasing mechanisms employing other types of spring devices are well known and hence could be usable with the chair of the present invention.

To control tilting of the seat and back assemblies relative to the base, a control linkage 51 is operatively coupled between the base and the seat frame or cradle 21, and is additionally coupled to the upright arrangement 31, as explained below.

The tilt control linkage 51 includes two substantially identical linkages which are effectively mirror images of one another and are disposed on opposite sides of the chair control housing 41 for cooperation with the respective lower upright arms 33 and cradle side frame elements 23 as associated with the same side of the chair, as described below. Only one of the linkages 51 is described, it being understood that both linkages cooperate and function simultaneously in the same manner as described.

More specifically, the control linkage 51 permits synchronized but relative tilting of the seat and back with respect to the base, and for this purpose includes a main control link or lever 52 which is elongated in the front-to-rear direction of the chair and which, at a forward end thereof, has a transverse pivot shaft 53 which is rotatably supported with an opening 54 associated with one side of the control housing 41 so as to define a transverse horizontal hinge axis 55. The hinge axis 55 is generally parallel with but spaced rearwardly and downwardly from the main tilt axis 43. The other or rearward end of the main control lever 52 also has a transversely projecting pivot shaft end 56 mounting thereon a roller 57 rotatable about a transverse horizontal axis 58 which is generally parallel with but spaced rearwardly from the hinge axis 55. The roller 57 is confined for movement within an elongate slot 59 as formed in the inner side wall of the adjacent lower lever arm portion 33 of the upright side member 32. The slot 59 is elongated in the front-to-rear direction of the chair seat, and in the front-to-rear direction of the lower arm portion 33, with the longitudinal direction of the slot extending at a significant acute angle relative to the lengthwise direction of the main control lever 52 as defined transversely between the hinge axes 55 and 58.

The transverse shaft end 56 associated with the rearward end of control lever 52, in the illustrated embodiment, passes through an enlarged clearance hole 61 formed in the side element 23 of the seat cradle so as to permit access to the control slot 59 formed in the adjacent lever arm portion 33.

The control linkage 51 also includes a secondary control link or lever 62 which is also elongated in the front-to-rear direction of the chair seat. The secondary control lever 62 has openings 63 and 64 extending sidewardly (i.e. horizontally) therethrough adjacent the respective forward and rearward ends thereof. A horizontally oriented coupling pin 65 has one end thereof mounted in the front opening 63, and the other end thereof is engaged within a suitable opening 67 formed in the side of the seat cradle 21, whereby coupling pin 65 defines a transverse horizontal pivot axis 66 which is parallel with the main tilt axis 43. The opening 67 formed in the seat cradle 21 is positioned within the lower or base leg of the generally U-shaped side frame element 23, and is positioned more closely adjacent the forward end of this base leg. The opening 64 as associated with the rearward end of the secondary control lever 62 is pivotally engaged around the rear transverse pivot shaft 56 associated with the main control lever 52 so that secondary lever 62 and main lever 52 are coupled together for relative pivoting movement about the axis 58.

In addition to the control linkage 51, the synchronized but differential tilting of the seat and back with respect to the base is further controlled by a pivotal support mechanism 71 which couples the seat cradle 21 to the upright arrangement 31. The pivotal support mechanism 71 includes a pair of aligned front rollers 72 which are mounted on opposite sides of the seat cradle 21 and project outwardly from the outer side surfaces of the side frame elements 23 in the vicinity of the front ends thereof. The aligned front rollers 72 define a pivot or rotational axis 73 which extends transversely in horizontal orientation so as to be generally parallel with the tilt axis 43. A further pair of rearward rollers 74 are similarly mounted on the outer sides of the cradle side frame elements 23 and are disposed in aligned relationship so as to be rotatable about a transverse horizontal axis 75 which is generally parallel with but spaced rearwardly a substantial distance from the front roller axis 73. The rear rollers 74 are positioned adjacent the rearward ends of the cradle side frame elements 23.

The pivotal support mechanism 71 also includes a pair of elongate front slots 76 and a further pair of elongate rear slots 77 which are formed in the lower lever arms 33 for individually movably accommodating therein a respective said front or rear roller 72 or 74. More specifically, the pair of front slots 76 open inwardly in opposed relationship to one another from the inner side surface of the lower lever arms 33, and in similar fashion the pair of rear slots 77 are disposed in opposed relationship to one another and open inwardly into the respective lower lever arms 33 from the inner side surface thereof. The front slots 76 are positioned between the tilt shaft 42 and the elongate slots 59 in the front-to-rear direction of the chair seat, and the rear slots 77 are positioned rearwardly of the slots 59 but somewhat forwardly from the upper upright arms 34.

Figure 6:
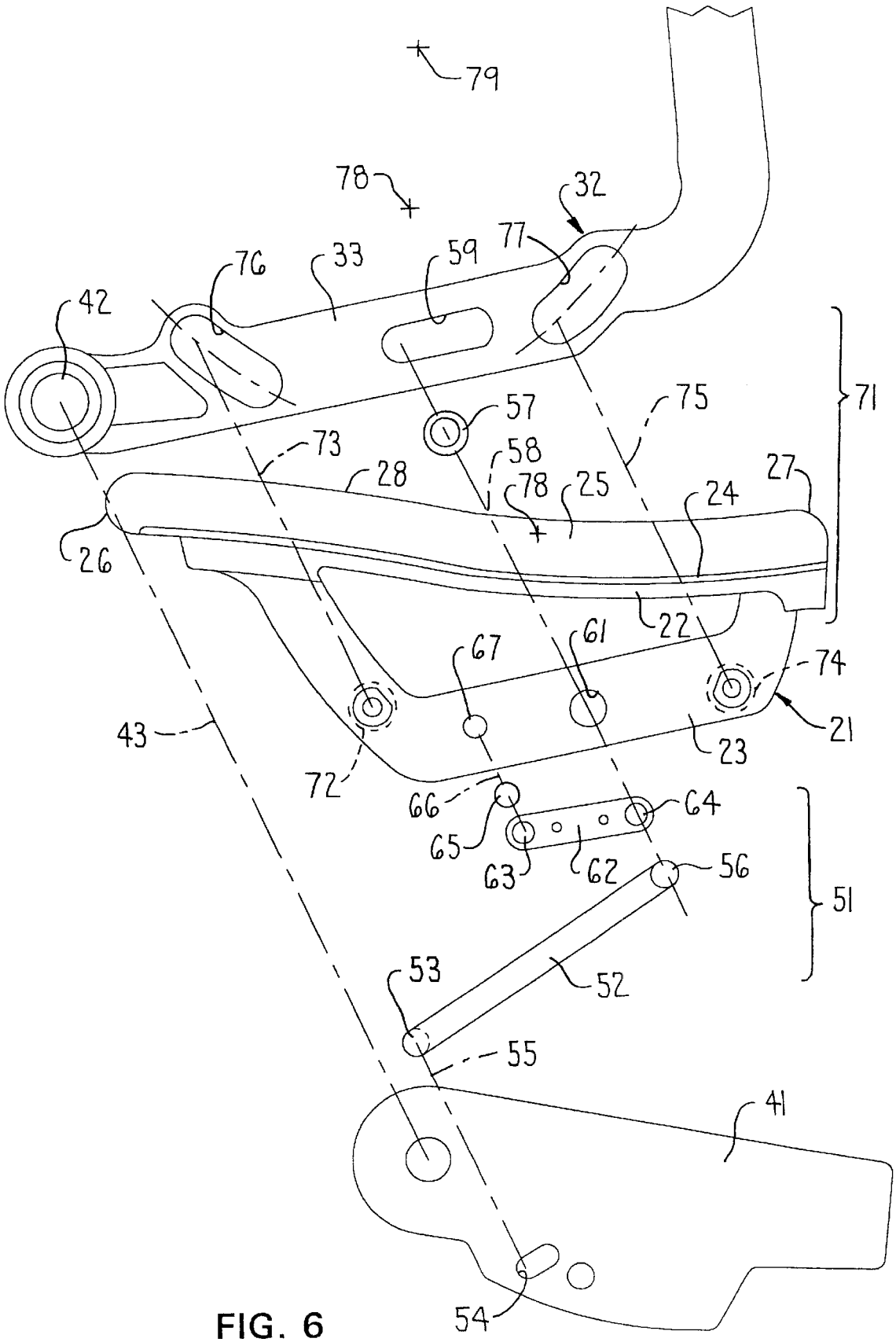
FIG. 6 is a side elevational view similar to FIG. 3 but showing various parts in a separated position for clarity of illustration.
Figure 7B:
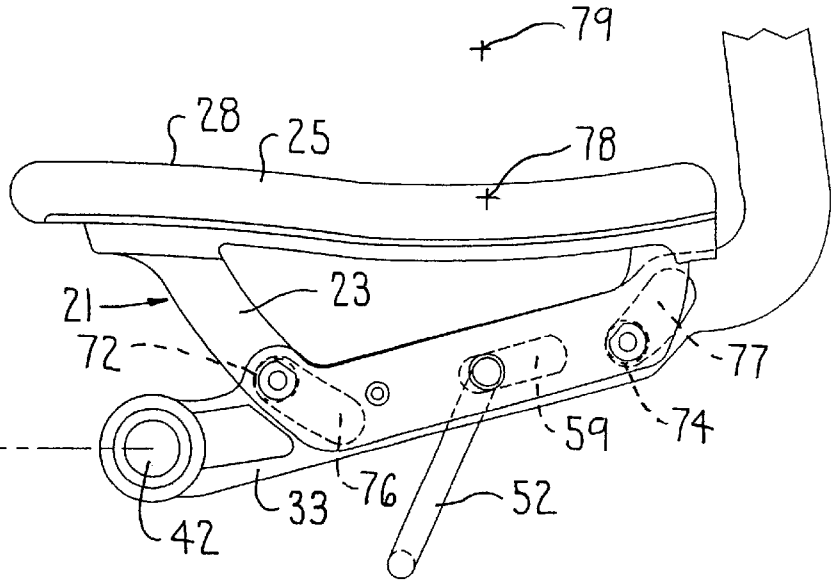
FIGS. 7A and 7B are enlarged side elevational views which respectively diagrammatically depict the relationships of the chair seat and back when in both the normal upright position and the maximum rearward tilt position.
Figure 7A:
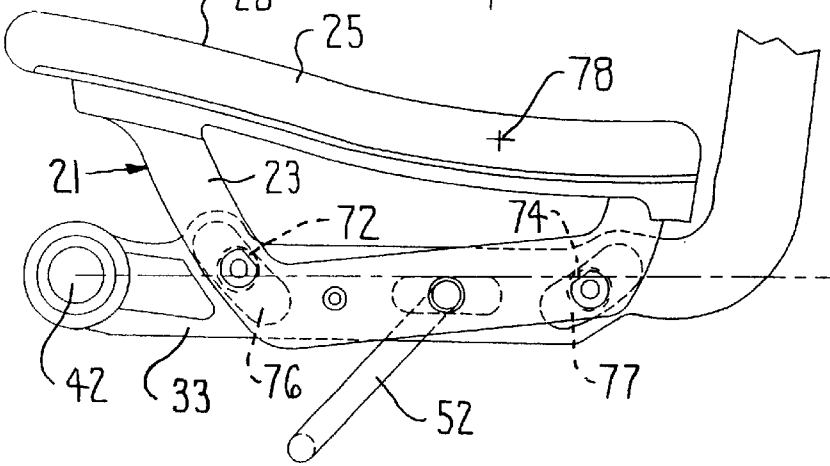

The front slots 76 and the rear slots 77 are both of an upwardly-facing arcuate configuration in that they are each generated on a uniform radius generated about a common center point or axis 78 which, as illustrated in FIG. 6, is positioned at an elevation whereby this center point or axis 78 is preferably a small distance below the upper surface 28 of the seat cushion 23 when the seat cushion is not deformed, i.e., the seat is not occupied. The center point or axis 78, however, is disposed more closely adjacent the rear edge 27 of the seat cushion but is spaced forwardly therefrom so as to be, when viewed horizontally, spaced forwardly a small distance from the back 36. The center point or axis 78 is preferably oriented so as to be generally aligned with but spaced vertically downwardly from the hip point or hip axis 79 associated with the hips of the chair occupant, which hip axis 79 is always spaced upwardly a small distance above the chair seat and is always spaced forwardly a small distance (i.e., several inches) from the chair back.

In the construction of the present invention, however, the center point or axis 78 used for generating the curvature of the slots 76 and 77 is typically spaced downwardly a small distance below the upper surface 28 of the nondeformed seat cushion 23 such that, when the seat cushion 23 and the upper surface 28 thereof are deformed downwardly due to an occupant seated thereon, the upper surface 28 of the seat cushion at least in the center portion thereof directly under the occupant's hips is deformed downwardly so that the generating axis 78 for the slots 76–77 is preferably disposed at and more preferably slightly above the upper surface 28 of the occupant-deformed cushion 25, whereby the axis 78 will more closely be positioned for substantially tangential contact with the outer periphery of the occupant's hip bones. With this relationship, the occupant's hips where they contact the deformed chair seat thus remain stationary during synchronized rearward tilting of the seat and back with respect to the chair base.

In the arrangement of the present invention, the center point or axis 78 will typically be in the range of about one-half to about one inch below the upper surface 28 of the seat cushion 25 when the latter is unoccupied and hence not compressed or externally deformed.

When the chair is in an unoccupied condition, the seat-back arrangement 17 will be maintained in its generally upright or forward position due to the resilient urging of the spring or biasing mechanism 81 associated with the control assembly, which biasing mechanism always urges the seat-back assembly in a vertical direction about the tilt axis 43 (counterclockwise in FIGS. 6 and 7) into engagement with a suitable stop which defines the upright position. When the chair is occupied, however, the occupant may elect to tilt rearwardly by applying suitable backward pressure against the chair back, causing the back assembly to tilt rearwardly (clockwise in FIGS. 6 and 7) about the tilt axis 43 against the urging of the biasing or spring device 81. The rearward tilting of the upright arrangement 31 about tilt axis 43 causes the lower upright arms 33 to vertically swing downwardly about axis 43. This movement causes the main control lever 52 to also swing downwardly, and simultaneously causes the roller 57 as engaged in the slot 59 to move rearwardly along the slot 59 as defined in the lower upright arm 33. The downward swinging of upright lower arm 33 also causes the seat cradle 21 to be swung downwardly therewith due to the engagement of the rollers 72 and 74 within the respective slots 76 and 77. This connection tends to tilt the seat cradle downwardly at the same rate as the back upright arrangement. Simultaneous with this latter movement, however, the movement of the roller 57 rearwardly along the slot 59 exerts a rearward pulling force on the secondary control lever 62 which hence pulls the seat cradle 21 rearwardly causing the rollers 72 and 74 to move rearwardly along the respective slots 76 and 77. Due to the arcuate curvature of the slots 76–77 as generated about the axis 78, this causes the seat cradle 21 to effectively rotate about the axis 78 relative to the lower upright lever arms 33 as the latter swing downwardly about axis 43. This relative rotation of the seat cradle 21, however, is in the opposite rotational direction to that of the lower upright arms 33, although at a lesser rate, so that the overall net effect is that the seat cradle 21 also effectively tilts rearwardly simultaneous with the rearward tilting of the lever arms 33, except that the rearward tilting of the seat cradle occurs at a significantly lesser rate of movement.

During the aforementioned movement, the tilting of the seat cradle 21 relative to the back assembly occurs about the axis 78 which is approximately vertically aligned with but spaced downwardly below the occupant's hip axis 79, with the center of relative tilting movement 78 being positioned adjacent and typically slightly above the deformed upper surface 28 of the seat cushion so that this tilt axis 78 is positioned to approximately transversely intersect the rounded exterior profile of the occupant's hip bones whereby, during the rearward flexing of the occupant's upper body portion about the hips relative to the lower body portion, the movement of the body closely conforms with the simultaneous but relative tilting movements of the back and seat so as to permit comfortable disposition of the occupant on the seat without undergoing significant relative sliding at the contact areas. At the same time the rearward tilting permits the occupant's knees to readily flex in an opening direction while the occupant's feet remain properly and comfortably engaged with the floor with overall rearward tilting of the occupant being permitted due to rearward flexing of the occupant's legs about the ankles.

Figure 10:
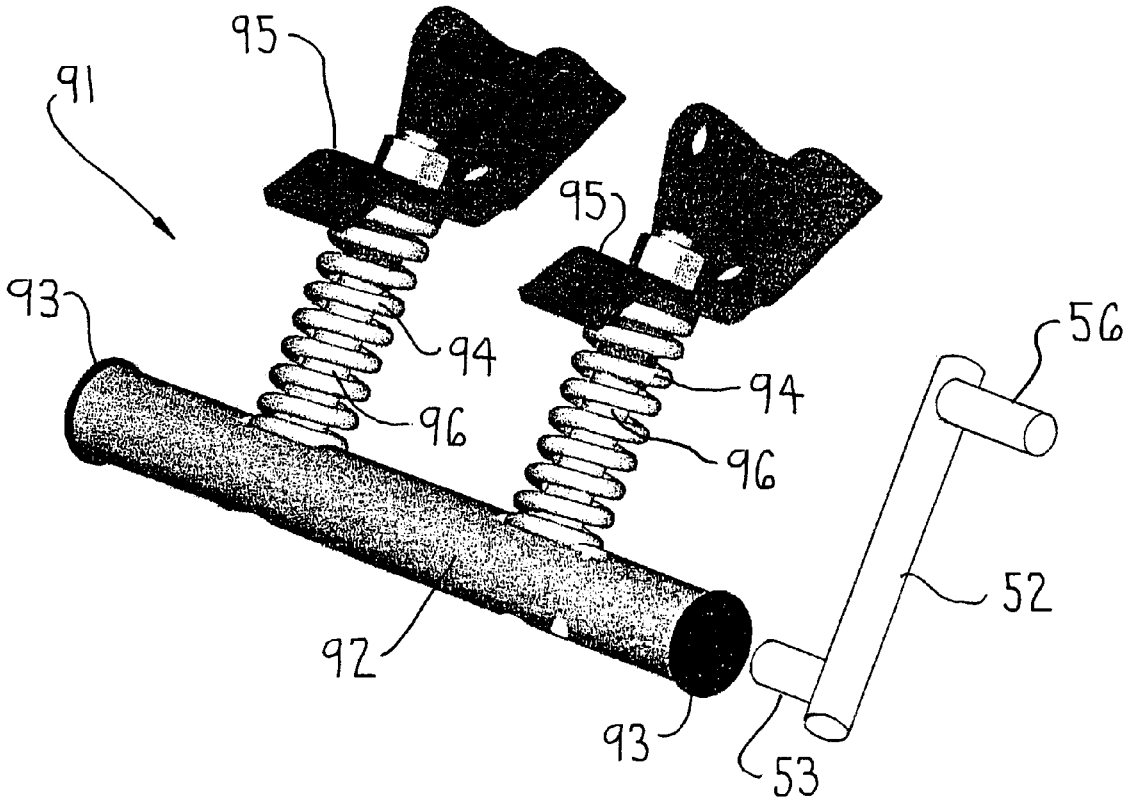
FIG. 10 is a perspective view illustrating a resilient support which couples between the base and the synchrotilt control linkage for permitting limited forward tilt of the chair seat independent of the rear tilt linkage.

The control linkage 51 of the present invention also includes a resilient support 91 (FIG. 10) which is associated with the forward shaft end 53 of the main control lever 52 for permitting the seat cradle 21 to rock or rotate through a small angle about the axis 78 in a direction which permits the front edge 26 of the seat cushion to be depressed, even though the upright structure 31 is maintained stationary.

More specifically, as illustrated in FIG. 6, the opening 54 formed in the control housing 41, through which the forward hinge shaft 53 projects, is formed as a slot which is elongated generally in the elongate direction of the main control lever 52. The forward shaft ends 53 associated with the main control levers 52 project through the elongate openings or slots 54 formed in opposite sides of the hollow control housing 41, which slots 54 and their cooperation with the shaft ends 53 define lost-motion connections. These forward shaft ends 53 are in turn rotatably engaged within support sleeves or bearings 93 mounted within opposite ends of a horizontally elongate support shaft 92 which is positioned interiorly of the hollow control housing 41 and extends transversely of the chair. The support shaft 92 cooperates with a pair of biasing springs 94 which have one ends thereof transversely bearing against the shaft, and the other ends anchored with respect to mounting brackets 95 which are fixedly secured with respect to the control housing 41. Guide rods 96 are fixed to the brackets 95 and project through the interior of the springs 94, with the other ends of the guide rods being transversely slidably supported on the support shaft 92. The springs 94 acting against the support shaft 92 urge the support shaft transversely such that the forward hinge shafts 53, as engaged with opposite ends of the support shaft 92, are normally maintained in engagement with the forward ends of the elongate slots 54 formed in the control housing side walls.

Under most operating conditions, the forward shaft ends 53 are normally resiliently maintained in engagement with the forward ends of the housing slots 54, and rearward tilting of the chair as described above will occur in a normal manner, during which the forward shaft ends 53 associated with the control linkage 51 remain positioned in abutting engagement with the forward end walls of the slots 54.

However, if the chair occupant leans forwardly in the chair or shifts his/her body weight onto the front portion of the chair seat, which force must be sufficient to overcome the biasing of the springs 94 associated with the resilient support 91, then the seat cradle 21 rotates about the axis 78 in a direction whereby the rollers 72 and 74 move rearwardly of their respective slots (counterclockwise in FIG. 6), which pivoting of the seat cradle causes the secondary links 62 to be displaced rearwardly a limited extent, thereby exerting a rearward pulling force on the primary control links 52 causing the forward shaft ends 53 thereof to move rearwardly along the elongate slots 54, and thus causing corresponding rearward movement of support shaft 92 and additional compression of springs 94. In this manner the seat cradle 21 can be controlled by the occupant so as to tilt forwardly through a small angular extent and hence effect a slight downward movement or lowering of the front edge of the seat. Such tilting of the seat cradle and lowering of the front edge of the seat can be accomplished wholly independently of the back and of the upright structure, the latter typically being maintained in the stationary upright position when the occupant effects forward tilting of the seat.

When the extra occupant-created downward force imposed on the front of the chair seat is relieved or shifted rearwardly, the force of the springs 94 acting against the support shaft 92 is sufficient to return the control linkage 91 back to its original position and hence effect reverse rotating of the seat cradle 21 back to its normal position with respect to the upright 31.

While the invention as described above illustrates the seat defined by a seat cushion 25 positioned on a seat shell, it will be appreciated that the seat may be defined by a sheet of flexible or elastic fabric (i.e. mesh) which, in a nonoccupied position of the chair, correspond generally to the upper surface of the cushion, with the fabric deforming and functioning in the same manner as the upper surface of the cushion when the chair is occupied.

While the presence of the elongate slot 54 as associated with the pivot shaft 53 at the forward end of the control linkage has been described above as permitting independent forward tilting of the chair seat through a small extent, such as a small angle of about 3°, with the chair seat being returned to its normal position by the biasing device, it will be appreciated that this control slot 54 could also be used to provide a small degree of downward angular adjustment of the front portion of the chair seat. Under such situation, the support shaft 92 associated with the axis at the forward end of the control linkage would, in place of the springs 96, instead be provided with a manual adjustment mechanism such as a manually rotatable screw rotatably supported on the control housing and transversely threadably engaged with the shaft 92 so as to permit displacement of the shaft 92 along the longitudinal limits of the slot 54. This hence would enable the chair occupant to provide limited manual adjustment with respect to the normal position of the chair seat and hence permit the chair seat to be adjusted to more suitably accommodate the occupant's desired position. This adjustment, however, would not interfere with the synchro-tilt motion associated with the back and seat as described above.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A chair comprising:

a base;

a deformable seat member positioned above the base and having an occupant-deformable upper surface disposed for engagement with a chair occupant, said seat member being mounted on a seat frame;

a back member projecting upwardly from adjacent a rear edge of the seat member;

a rigid upright structure connected to said base for vertical pivoting movement about a first substantially horizontal pivot axis which is positioned below said seat member and extends transversely relative thereto, said upright structure including an upright part which projects upwardly adjacent the rear edge of said seat member and which mounts said back member thereon;

a pivot structure connected between said seat frame and said upright structure for permitting said seat member to pivot relative to said upright structure about a second substantially horizontal axis which is generally parallel with but displaced upwardly and rearwardly from said first axis, said second axis being positioned at an elevation at or only a small distance below the upper surface of the seat member when the seat member is not deformed by a seated occupant; and a control linkage connected between said base and said seat frame for causing the seat member to tilt relative to the upright structure in one rotational direction about said second axis in response to rearward tilting of said upright structure in the opposite rotational direction about said first axis.

2. A chair according to claim 1, wherein said control linkage at one end thereof is pivotally connected to said base and at the other end thereof is pivotally connected to said seat frame, and said control linkage at an intermediate location between the ends thereof is connected to said upright structure for controlled relative movement therebetween.

3. A chair according to claim 1, wherein:

said base includes a central height-adjustable pedestal provided with a control housing fixed to an upper end thereof, said control housing being positioned beneath said seat member;

said control linkage including a first elongate control link pivotally connected at a front end thereof to said control housing about a third generally horizontal pivot axis which is substantially parallel with said first axis, a second elongate control link pivotally connected at a front end thereof to said seat frame about a fourth generally horizontal pivot axis which is substantially parallel to said third axis, and rearward ends of said first and second control links being pivotally joined together about a fifth substantially horizontal pivot axis which is parallel with but spaced rearwardly from said third and fourth pivot axes, one of said control links having a guide structure associated therewith at said fifth pivot axis and disposed in slidable engagement with said upright structure.

4. A chair according to claim 3, wherein;

said upright structure includes a lower lever part which is disposed below said seat member and which at a forward end is hingedly supported on said base for pivoting about said first pivot axis, said lower lever part adjacent a rearward end thereof being rigidly joined to said upright part, said lower lever part having an elongate guide slot formed therein and extending in a front-to-back direction of the chair seat, and said guide structure being slidably positioned within said guide slot for movement in the elongate direction thereof.

5. A chair according to claim 4, wherein:

said pivot structure includes front and rear elongate arcuate slots formed in said lower lever part, said front and rear arcuate slots being generated about said second pivot axis, and said seat frame mounting thereon front and rear rollers which are confined in the respective front and rear arcuate slots of said lower lever part for movement along the arcuate slots to permit tilting of the seat frame and of the seat member mounted thereon about said second pivot axis.

6. A chair according to claim 5, wherein:

a pivot shaft at the front end of said first control link and defining said third axis projects through an elongate slot formed in a side wall of the control housing, and a spring device acting against the pivot shaft to normally maintain it against a front end of the control housing slot, whereby forward shifting of an occupant's weight on the seat member causes the seat frame to rock forwardly and downwardly about said second pivot axis to lower the front edge of the seat member and to cause the first control link to be pulled rearwardly along said control housing slot against the urging of said spring device.

7. A chair according to claim 2, wherein:

said upright structure has a lower lever part which is disposed below said chair seat and which at a forward end thereof is pivotally joined to said base for vertical pivoting about said first pivot axis, said lower lever part at a rearward end being rigidly joined to said upright part; and said pivot structure including front and rear elongate arcuate slots formed in said lower lever part, said front and rear arcuate slots being generated about said second pivot axis, and said seat frame mounting thereon front and rear rollers which are confined in the respective front and rear arcuate slots of said lower lever part for movement along the arcuate slots to permit tilting of the seat frame and of the seat member mounted thereon about said second pivot axis.

8. A chair according to claim 3, wherein:

a pivot shaft at the front end of said first control link and defining said third axis projects through an elongate slot formed in a side wall of the control housing, and a spring device acting against the pivot shaft to normally maintain it against a front end of the control housing slot, whereby forward shifting of an occupant's weight on the seat member causes the seat frame to rock forwardly and downwardly about said second pivot axis to lower the front edge of the seat member and to cause the first control link to be pulled rearwardly along said control housing slot against the urging of said spring device.

9. A chair comprising:

a base;

a deformable seat member positionable above said base and having an occupant-deformable upper surface disposed for engagement with a chair occupant, said seat member being mounted on a seat frame;

a back member projecting upwardly from adjacent a rear edge of the seat member;

a rigid upright structure connected to said base for vertical pivoting movement about a first substantially horizontal pivot axis which is positioned below a front portion of said seat member and extends transversely thereto, said upright structure including a lower lever part which at a forward end is pivotally joined to said base for pivoting about said first pivot axis and which projects rearwardly beneath the seat member and at a rearward end thereof is rigidly joined to an upright part which projects upwardly adjacent the rear edge of said seat member and which mounts said back member thereon;

a motion-permitting structure connected between said seat frame and said upright structure for permitting said seat member to move relative to said upright structure; and a control linkage connected between said base, said upright structure and said seat frame for causing the seat member and its seat frame, when the upright structure is tilted rearwardly and downwardly about said first pivot axis, to synchronously tilt rearwardly with the upright structure but at a lesser tilt rate;

said control linkage including a first elongate control link which at a front end is supported on said control housing for pivoting about a second transverse axis, said first control link projecting rearwardly and at a rearward end thereof being pivotally joined to a rearward end of a second elongate control link about a third transverse pivot axis which is generally parallel with said second axis, said second control link being elongated forwardly from said third axis and at a forward end thereof being pivotally connected to said seat frame about a fourth transverse pivot axis which is generally parallel with said second axis, said control linkage also including a guide member coupled to and carried by one of said control links at said third pivot axis and disposed in front-to-back guided engagement with the lower lever part of said upright structure, whereby downward rearward tilting of said upright structure about said first axis causes a corresponding downward tilting of said seat frame and said seat member mounted thereon through a smaller angle; and a biasing device cooperating with the upright structure for normally urging the upright structure and the back member mounted thereon into an upright position.

10. A chair according to claim 9, wherein:

said second pivot axis associated with the front end of said first control link is supported for limited front-to-rear movement relative to said base by a slot defined in said base, and a biasing unit cooperating between said base and said first control link for normally maintaining said second pivot axis adjacent a forward end of said slot, said latter slot permitting said second axis to move rearwardly therealong against the urging of said biasing unit in response to downward displacement of the front edge of the seat member relative to the upright structure in response to application of increased external downward force on the front portion of the seat member.

11. A chair according to claim 9, wherein said lower lever part includes a pair of sidewardly-spaced but generally parallel lever members which are disposed under and positioned adjacent opposite sides of the seat member, said seat frame including a pair of side frame parts which are sidewardly spaced apart and are positioned between and respectively adjacent the lower lever members, said base including a control housing positioned generally between the side frame parts, and said seat frame being mounted on said lever parts for permissible pivoting movement of the seat frame relative to the upright structure about a fifth pivot axis which extends generally parallel with said first pivot axis, said fifth pivot axis being disposed generally within a transverse vertical plane which passes through a hip axis of the chair occupant but being positioned vertically downwardly a substantial distance below the occupant's hip axis.

12. A chair according to claim 11, wherein:

said fifth axis is positioned below the upper surface of the seat member when the chair is unoccupied, and upwardly relative to said first pivot axis.

13. A chair comprising:

a base;

a seat member positioned above said base and mounted on a seat frame;

a back member projecting upwardly from adjacent a rear edge of the seat member;

a rigid upright structure connected to said base for vertical pivoting movement about a first substantially horizontal pivot axis which is positioned below a front portion of said seat member and extends transversely relative thereto, said upright structure including an upright part which projects upwardly adjacent the rear edge of said seat member and which mounts said back member thereon;

a pivot structure connected between said seat frame and said upright structure for permitting said seat member to pivot relative to said upright structure about a second substantially horizontal axis which is generally parallel with but displaced upwardly and rearwardly from said first axis;

a control linkage connected between said base and said seat frame for causing the seat member and its seat frame, when the upright structure is tilted rearwardly and downwardly about said first pivot axis, to synchronously tilt rearwardly with the upright structure but at a lesser tilt rate, said control linkage at one end thereof having a first pivotal connection to said base and at the other end thereof having a second pivotal connection to said seat frame, said first and second pivotal connections being respectively defined by third and fourth transverse pivot axes which extend generally parallel with said first pivot axis; and a lost-motion connection associated with one of said first and second pivotal connections for permitting the seat frame, when the chair is in a normal upright position, to pivot forwardly and downwardly a limited amount relative to said upright structure about said second axis to permit limited lowering of the front portion of the seat member.

14. A chair according to claim 13, wherein said first connection is associated with a forward end of said control linkage and connects to said base, said lost-motion connection being associated with said first connection and including an elongate slot formed in said base and projecting generally in a front-to-rear direction for permitting limited displacement of said first connection along said slot.

15. A chair according to claim 14, including a biasing device which cooperates with said first connection for normally maintaining said first connection adjacent a forward end of said slot, whereby application of increased external force to the front portion of the seat member causes the seat member to rock forwardly and downwardly on the upright structure about said second axis and simultaneously moves said first connection rearwardly of the slot against the urging of said biasing device, said biasing device assisting in returning the first connection toward the front end of the slot to assist in returning the seat frame to its normal upright position.

16. A chair according to claim 13, wherein said second axis is disposed generally within a transverse vertical plane positioned to approximately contain the hip axis of the seated occupant.

17. A chair according to claim 1, wherein the control linkage at one end thereof is pivotally connected to said base at a first pivotal connection and at the other end thereof is pivotally connected to said seat frame at a second pivotal connection, one of said first and second pivotal connections being defined by a pivot shaft which is engaged in and slidably movable relative to a transversely elongate slot, and a spring device associated with said one pivotal connection to normally maintain the pivot shaft against one end of the slot during pivoting movement of the upright structure and of the back member mounted thereon, and wherein forward shifting of the occupant's weight on the seat member causes the seat frame to tilt forwardly and downwardly about said second pivot axis to lower the edge of the seat member and to cause the pivot shaft to be relatively slidably moved along the slot away from the end thereof against the urging of the spring device.

18. A chair according to claim 1, wherein said control linkage at one end thereof is connected to said base by a first pivotal connection and at the other end thereof is pivotally connected to said seat frame by a second pivotal connection, and a lost-motion connection associated with one of said first and second pivotal connections for permitting the seat frame, when the chair is in a normal upright position, to tilt forwardly and downwardly a limited amount relative to said upright structure about said second axis to permit limited lowering of the front portion of the seat member in response to forward shifting of an occupant's weight on the seat member.

19. A chair according to claim 18, wherein a spring device cooperates with the lost-motion connection for imposing a biasing force on the seat frame which opposes the forwardly and downwardly tilting thereof as caused by forward shifting of the occupant's weight.

20. A chair according to claim 13, wherein a spring device cooperates with the lost-motion connection for normally imposing a biasing force on the seat frame which opposes the forwardly and downwardly rocking thereof as caused by forward shifting of the occupant's weight.

21. A chair according to claim 13, wherein said lost-motion connection includes a pivot shaft which defines one of said third and fourth pivot axes and which is transversely slidably confined within a transversely elongate slot, and a spring device cooperating with the pivot shaft for normally maintaining the pivot shaft at one end of the slot while permitting the pivot shaft to be relatively slidably moved away from said one end when said seat member is tilted forwardly and downwardly due to forward shifting of the occupant's weight.

* * * * *

UNITED STATES PATENT AND TRADEMARK OFFICE

CERTIFICATE OF CORRECTION

PATENT NO. : 6,644,741 B1
DATED : November 11, 2003
INVENTOR(S) : Patrick C. Nelson et al.

It is certified that error appears in the above-identified patent and that said Letters Patent is hereby corrected as shown below:

Title page, Item [54] and Column 1, line 1,
Please change "CHAIR" to -- SYNCHROTILT CHAIR --.

Column 11,
Line 46, change "control" to -- base --.
Line 47, delete "housing".

Signed and Sealed this

Thirteenth Day of April, 2004

JON W. DUDAS
*Acting Director of the United States Patent and Trademark Office*